US009142394B2

(12) United States Patent
Yamamoto

(10) Patent No.: US 9,142,394 B2
(45) Date of Patent: Sep. 22, 2015

(54) TANDEM QUADRUPOLE MASS SPECTROMETER

(71) Applicant: SHIMADZU CORPORATION, Kyoto-shi, Kyoto (JP)

(72) Inventor: Hideki Yamamoto, Ikeda (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/508,086

(22) Filed: Oct. 7, 2014

(65) Prior Publication Data

US 2015/0102219 A1 Apr. 16, 2015

(30) Foreign Application Priority Data

Oct. 11, 2013 (JP) ..... 2013-213315

(51) Int. Cl.
*H01J 49/26* (2006.01)
*H01J 49/00* (2006.01)
*H01J 49/42* (2006.01)

(52) U.S. Cl.
CPC ..... *H01J 49/005* (2013.01); *H01J 49/4215* (2013.01)

(58) Field of Classification Search
USPC ..... 250/281, 282, 283, 286, 287; 702/22, 702/23, 24, 25, 26, 27, 28
See application file for complete search history.

(56) References Cited

U.S. PATENT DOCUMENTS 5,436,165 A * 7/1995 Brenner ..... 436/149
6,245,299 B1 * 6/2001 Shiloh et al. ..... 422/121

FOREIGN PATENT DOCUMENTS

JP 2013-15485 A 1/2013

OTHER PUBLICATIONS

"LCMS-8040 Chou-Kousoku Toripuru Shijuukyoku-gata LC/MS/MS Shisutemu MRM Saitekika Kinou (LCMS-8040 Ultra-High Speed Quadrupole LC/MS/MS System: MRM Optimizing Function)", a web page on the website of Shimadzu Corporation, http://www.an.shimadzu.co.jp/lcms/lcms8040/8040-5.htm.

* cited by examiner

*Primary Examiner* — Nicole Ippolito
(74) *Attorney, Agent, or Firm* — Sughrue Mion, PLLC

(57) ABSTRACT

Prior to multiple reaction monitoring (MRM) measurement condition optimization, an analysis operator prepares, for each precursor ion of an objective compound, two lists on a product-ion selection condition setting screen 200, i.e. a list 203 which shows ions to be preferentially selected as product ions for which the optimization needs to be performed and a list 202 which shows ions to be excluded from the optimization. When a measurement is performed, a product-ion scan measurement for the precursor ion of the objective compound is performed and a spectrum is obtained. Among the ions extracted from this spectrum, any ion registered in the excludable-ion list 202 is excluded, while any ion registered in the preferred-ion list 203 is preferentially selected as a product ion. For each combination of the m/z values of the precursor ion and the product ions thus determined, optimum conditions of the MRM measurement are searched for.

3 Claims, 4 Drawing Sheets

TANDEM QUADRUPOLE MASS SPECTROMETER

TECHNICAL FIELD

The present invention relates to a tandem quadrupole mass spectrometer (which may also be called a triple quadrupole mass spectrometer), and more specifically, to a tandem quadrupole mass spectrometer having the function of automatically determining control parameters for optimum voltages and the like in a multiple reaction monitoring (MRM) measurement.

BACKGROUND ART

A method called an MS/MS analysis (or tandem analysis) is widely used as one of the mass spectrometric techniques for identification, structural analyses or quantitative determination of compounds having large molecular weights. There are various kinds of mass spectrometers with different configurations designed for the MS/MS analysis, among which tandem quadrupole mass spectrometers are characterized by their relatively simple structures as well as easy operation and handling.

As described in Patent Literature 1 or other references, in generally used tandem quadrupole mass spectrometers, ions generated from compounds in an ion source are introduced into a front-stage quadrupole mass filter (which is commonly represented as "Q1"), in which an ion having a specific mass-to-charge ratio m/z is selected as a precursor ion. This precursor ion is introduced into a collision cell containing an ion guide with four (or more) poles (this ion guide is commonly represented as "q2"). A collision-induced dissociation (CID) gas, such as argon, is supplied into this collision cell, and the precursor ion introduced into the collision cell collides with this CID gas, to be fragmented into various kinds of product ions. These product ions are introduced into a rear-stage quadrupole mass filter (which is commonly represented as "Q3"), whereby a product ion having a specific mass-to-charge ratio m/z is selectively allowed to pass through this filter, arrive at a detector and be detected.

An MRM measurement mode is one mode of the MS/MS measurement available in tandem quadrupole mass spectrometers. In the MRM measurement mode, the mass-to-charge ratio of an ion to be allowed to pass through is fixed in each of the front-stage and rear-stage quadrupole mass filters so as to measure the intensity (amount) of a specific kind of product ion produced from a specific kind of precursor ion. The two-stage mass filtering in the MRM measurement enables the removal of ions and neutral particles originating from impurities or compounds which are not the target of the measurement, so that ion intensity signals with high S/N ratios can be obtained. Due to this feature, the MRM measurement is particularly effective for the quantitative determination of a trace constituent.

Tandem quadrupole mass spectrometers can be used independently. However, they are often coupled with a liquid chromatograph (LC) or a gas chromatograph (GC). For example, the liquid chromatograph tandem mass spectrometer (LC/MS/MS), in which a tandem quadrupole mass spectrometer is used as a detector for a liquid chromatograph, is frequently used for a quantitative analysis of a compound contained in a sample which contains a large number of compounds or a sample which contains impurities.

When an MRM measurement is performed with an LC/MS/MS (or GC/MS/MS), a combination of the mass-to-charge ratio of a target precursor ion and that of a product ion must be set, as one item of the measurement conditions, in association with the retention time of an objective compound before the measurement of an objective sample is performed. By setting an optimum combination of the mass-to-charge ratios of the precursor ion and the product ion for each objective compound, the signal intensity of the ions originating from each objective compound can be obtained with high accuracy and high sensitivity, and the quantity of the compound can also be determined with high accuracy and high sensitivity. The combination of the mass-to-charge ratios of the precursor ion and the product ion can be manually set by analysis operators. However, the manual setting is considerably cumbersome and yet does not always ensure successful setting of an optimum combination. To address this problem, a system capable of an automatic and highly reliable setting of an optimum combination of the mass-to-charge ratios of the precursor ion and the product ion for an objective compound has been developed, as disclosed in Patent Literature 1.

A high-accurate and high-sensitive quantitative determination of an objective compound by an MRM measurement does not only require the aforementioned optimum setting of the combination of the mass-to-charge ratios of the precursor ion and the product ion for the objective compound but also the optimum setting of the collision energy and other measurement conditions for that combination. As described in Non Patent Literature 1, mass spectrometers having the function of automatically optimizing control parameters used in the MRM measurement have also been commonly known (this function is hereinafter called the "MRM measurement condition optimizing function"). In an example described in Non Patent Literature 1, the control parameters include the "Q1 pre-rod voltage" in the front-stage quadrupole mass filter, the "Q3 pre-rod voltage" in the rear-stage quadrupole mass filter and the "collision energy CE."

Conventional MRM measurement condition optimizing functions can be classified into the following two methods:

(1) An analysis operator specifies a combination of the mass-to-charge ratios of the precursor ion and the product ion originating from a target compound. Then, an analysis of a known sample containing that compound (e.g. a standard sample) is performed so as to search for optimum values of the control parameters for the specified combination of the mass-to-charge ratios of the precursor ion and the product ion. The result is shown on a display unit.

(2) An analysis operator only specifies the mass-to-charge ratio of the precursor ion originating from the target compound. Then, a product-ion scan measurement of the specified precursor ion is performed using a known sample containing that compound to obtain a product-ion spectrum, and a predetermined number of product-ion peaks are selected from that spectrum in descending order of signal intensity. Subsequently, for each combination of the originally specified precursor ion and each of the selected product ions, the search for the optimum values of the control parameters is conducted and the result is shown on a display unit.

In the case of method (1), the analysis operator needs to have previous knowledge of not only the mass-to-charge ratio of the precursor ion originating from the compound but also that of the product ion. By contrast, method (2) has the advantage that an appropriate product ion is automatically searched for and appropriate values of the control parameters can be obtained even if the analysis operator does not know the mass-to-charge ratio of the product ion to be selected as a target. However, it should be noted that, in the case where a plurality of product ions are generated from one precursor ion, the product ion showing the highest signal intensity is not always the most suitable ion for quantitative determination; in some cases, a product ion with a lower signal intensity may have a higher degree of peak purity and be more suitable for quantitative determination. If the product ion most suitable for quantitative determination has such a low intensity that is not included in the predetermined number of ions selected in descending order of intensity, the optimum parameter values for that ion cannot be obtained by method (2).

In the previously described conventional MRM measurement condition optimizing function, it is assumed that the analysis is conducted in such a manner that a standard sample or a sample containing a single compound is introduced into the ion source of the tandem quadrupole mass spectrometer by infusion or flow injection. Therefore, the result of a series of measurements performed for one injection of the sample can be used to optimize the values of the control parameters for the MRM measurement for the mass-to-charge ratio of only one kind of precursor ion. If there are a number of precursor ions for which the values of the control parameters need to be optimized, the sample injection and the series of measurements need to be repeated as many times as that number, so that a considerable amount of time is required for optimizing the MRM measurement conditions.

CITATION LIST

Patent Literature

Patent Literature 1: JP 2013-15485 A

Non Patent Literature

Non Patent Literature 1: "LCMS-8040 Chou-Kousoku Toripuru Shijuukyoku-gata LC/MS/MS Shisutemu MRM Saitekika Kinou (LCMS-8040 Ultra-High Speed Quadrupole LC/MS/MS System: MRM Optimizing Function)", a web page on the website of Shimadzu Corporation

SUMMARY OF INVENTION

Technical Problem

The present invention has been developed to solve the previously described problems, and its primary objective is to provide a tandem quadrupole mass spectrometer having the function of optimizing the values of the control parameters for an MRM measurement in which the MRM measurement conditions for a product ion suitable for quantitative determination or other purposes can be assuredly optimized for each objective compound even if the signal intensity of the product ion to be selected as the target is low.

Another objective of the present invention is to provide a tandem quadrupole mass spectrometer with a liquid chromatograph or a gas chromatograph connected to its front side, the tandem quadrupole mass spectrometer being designed so as to reduce the period of time required for MRM measurement condition optimization for ions originating from a number of compounds.

Solution to Problem

The first aspect of the present invention aimed at solving the previously described problem is a tandem quadrupole mass spectrometer having front-stage and rear-stage quadrupole mass filters with a collision cell for fragmenting an ion in between, the tandem quadrupole mass spectrometer having the function of performing a multiple reaction monitoring (MRM) measurement condition optimization for searching for an optimum MRM measurement condition for one or a plurality of compounds while conducting an MRM measurement of a sample, and the tandem quadrupole mass spectrometer including:

a) a preferred ion registry for registering the mass-to-charge ratio of one or a plurality of product ions to be preferentially selected as a target, for each precursor ion, as a measurement condition for optimizing the MRM measurement condition; and b) an MRM measurement condition optimizer for performing the MRM measurement condition optimization for a target precursor ion originating from one compound by retrieving information about a preferred product ion for the precursor ion from the preferred ion registry, and if the preferred product ion is detected as a product ion for the precursor ion, controlling each section of the mass spectrometer so as to perform the MRM measurement condition optimization for the combination of the mass-to-charge ratios of the precursor ion and the preferred product ion and obtain an optimum value of a control parameter.

In the tandem quadrupole mass spectrometer according to the first aspect of the present invention, an analysis operator specifies the mass-to-charge ratio of a precursor ion to be selected as a target for each of one or a plurality of objective compounds, and specifies, for each precursor ion (i.e. for each objective compound), the mass-to-charge ratio or ratios of one or a plurality of product ions to be preferentially selected as the target, before carrying out the task of MRM measurement condition optimization. The specified product ions are registered for each precursor ion in the preferred ion registry.

When performing the MRM measurement condition optimization while conducting an actual measurement of a known sample containing the objective compound, the MRM measurement condition optimizer controls the front-stage quadrupole mass filter so as to select the precursor ion specified for the objective compound as well as the rear-stage quadrupole mass filter so as to perform a scan measurement (product-ion scan measurement) over a predetermined range of mass-to-charge ratios. As a result, a product-ion on a spectrum over the predetermined range of mass-to-charge ratios is obtained. Then, each peak corresponding to the product ion on the spectrum is detected, and if the detected product ion is found to be registered as a preferred product ion for the precursor ion concerned in the preferred ion registry, the product ion is extracted as the target. Subsequently, an optimum value of the collision energy for the combination of the mass-to-charge ratios of the precursor ion and the product ion is determined, for example, by investigating the change in the intensity of the product ion with respect to a change in the collision energy.

In the tandem quadrupole mass spectrometer according to the first aspect of the present invention, any product ion (e.g. a product ion having a low signal intensity as compared to other product ions) can be assuredly selected as a target of the MRM measurement condition optimization by being registered in the preferred ion registry. Therefore, for a given kind of compound, the optimization of the MRM measurement condition and the determination of the optimum values of the control parameters can be performed for an intended combination of the mass-to-charge ratios of the precursor ion and the product ion. This function is also effective for preventing an unnecessary period of time from being spent for the optimization of the MRM measurement condition, since no optimization of the MRM measurement condition is performed for product ions having high signal intensities yet being unnecessary or insignificant for the analysis.

In the tandem quadrupole mass spectrometer according to the first aspect of the present invention, in principle, a product ion which has been detected for a given precursor ion but is not registered for that precursor ion in the preferred ion registry will not be selected as the target of the MRM measurement condition optimization. However, in some cases, e.g. if a considerable amount of time is left after the MRM measurement condition optimization for the product ions registered in the preferred ion registry has been completed or if no ion which matches any of the product ions registered in the preferred ion registry has been found, one or more product ions which are not registered in the preferred ion registry may be selected as the target of the MRM measurement condition optimization.

The second aspect of the present invention aimed at solving the previously described problem is a tandem quadrupole mass spectrometer having front-stage and rear-stage quadrupole mass filters with a collision cell for fragmenting an ion in between, the tandem quadrupole mass spectrometer having the function of performing a multiple reaction monitoring (MRM) measurement condition optimization for searching for an optimum MRM measurement condition for one or a plurality of compounds while conducting an MRM measurement of a sample, and the tandem quadrupole mass spectrometer including:

a) an excludable ion registry for registering the mass-to-charge ratio of one or a plurality of product ions to be excluded from a target of the MRM measurement condition optimization, for each precursor ion, as a measurement condition for optimizing the MRM measurement condition; and b) an MRM measurement condition optimizer for performing the MRM measurement condition optimization for a target precursor ion originating from one compound by retrieving a manner that information about an excludable product ion or ions for the precursor ion from the excludable ion registry, excluding at least the excludable product ion or ions from the ions detected as product ions for the precursor ion, and controlling each section of the mass spectrometer so as to perform the MRM measurement condition optimization for the combination of the mass-to-charge ratios of the precursor ion and a product ion remaining after exclusion and obtain an optimum value of a control parameter.

In the tandem quadrupole mass spectrometer according to the second aspect of the present invention, an analysis operator specifies the mass-to-charge ratio of a precursor ion to be selected as a target for each of one or a plurality of objective compounds, and specifies, for each precursor ion (i.e. for each objective compound), the mass-to-charge ratio or ratios of one or a plurality of product ions to be excluded from the target, before carrying out the task of MRM measurement condition optimization. The specified product ions are registered for each precursor ion in the excludable ion registry.

When performing the MRM measurement condition optimization while conducting an actual measurement of a known sample containing the objective compound, the MRM measurement condition optimizer controls the front-stage quadrupole mass filter so as to select the precursor ion specified for the objective compound as well as the rear-stage quadrupole mass filter so as to perform a scan measurement (product-ion scan measurement) over a predetermined range of mass-to-charge ratios. As a result, a product-ion on a spectrum over the predetermined range of mass-to-charge ratios is obtained. Then, the peaks corresponding to the product ions on the spectrum are detected, and any product ion which is registered in the excludable ion registry is excluded from the detected product ions. After that, a predetermined number of product ions are extracted as the target, for example, in descending order of signal intensity from the remaining product ions. Subsequently, an optimum value of the collision energy for the combination of the mass-to-charge ratios of the precursor ion and the product ion is determined, for example, by investigating the change in the intensity of the product ion with respect to a change in the collision energy.

In the tandem quadrupole mass spectrometer according to the second aspect of the present invention, for example, even a product ion having a high signal intensity can be assuredly excluded from the target of the MRM measurement condition optimization by being registered in the excludable ion registry. This function is effective for preventing an unnecessary period of time from being spent for the optimization of the MRM measurement condition, since no optimization of the MRM measurement condition is performed for product ions having high signal intensities yet being unnecessary or insignificant for the analysis.

Naturally, it is possible to combine the first and second aspects of the present invention. For example, it is preferable to create a system in which each product ion registered in the excludable ion registry is initially excluded from the product ions detected on the product-ion spectrum, and subsequently, among the remaining product ions, each product ion which is registered in the preferred ion registry is preferentially selected as the target rather than in descending order of signal intensity and the MRM measurement condition optimization is performed for the combination of the mass-to-charge ratios of the precursor ion concerned and each of the selected product ions.

The third aspect of the present invention aimed at solving the previously described problem is a tandem quadrupole mass spectrometer having the function of performing a multiple reaction monitoring (MRM) measurement condition optimization for searching for an optimum MRM measurement condition for one or a plurality of compounds while conducting an MRM measurement of a sample, with a chromatograph for temporally separating compounds in a sample connected on the front side, the tandem quadrupole mass spectrometer including: an ion source for ionizing the components of an introduced sample; a front-stage quadrupole mass filter for selecting, as a precursor ion, an ion having a specific mass-to-charge ratio among various kinds of ions generated in the ion source; a collision cell for dissociating the precursor ion; a rear-stage quadrupole mass filter for selecting an ion having a specific mass-to-charge-ratio from various kinds of product ions resulting from the dissociation; and a detector for detecting an ion passing through the rear-stage quadrupole mass filter, and the tandem quadrupole mass spectrometer further including:

a) a measurement condition setter for setting, for each objective compound, the mass-to-charge ratio of a precursor ion to be selected as a target, a measurement starting time and a measurement finishing time as measurement conditions for optimizing the MRM measurement condition;

b) a measurement sequence creator for creating a measurement sequence for an MRM measurement condition optimization, based on the information of the measurement starting time and the measurement finishing time set in the measurement condition setter, so that the MRM measurement condition optimization for all objective compounds is performed with the smallest possible number of chromatographic analyses by selecting, sequentially with a lapse of time, objective compounds capable of being subjected to a measurement without causing any overlapping of measurement times, which results in a series of measurements in each chromatographic analysis, and by performing the MRM measurement condition optimization for each objective compound; and c) an MRM measurement condition optimizer for conducting the MRM measurement condition optimization while controlling each section of the mass spectrometer according to the measurement sequence created by the measurement sequence creator.

In general, in a liquid chromatograph mass spectrometer, a sample containing a single compound is introduced into the tandem quadrupole mass spectrometer by infusion or flow injection to perform the MRM measurement condition optimization for that compound. By contrast, in the tandem quadrupole mass spectrometer according to the third aspect of the present invention, a sample containing a plurality of objective compounds is introduced into the chromatograph to temporally separate those compounds, and an eluate containing the separated compounds is introduced into the mass spectrometer to perform the MRM measurement condition optimization for each objective compound. However, if there are two or more objective compounds having close retention times, it is difficult to perform the MRM measurement condition optimization for those objective compounds within the same slot of time.

To address this problem, in the tandem quadrupole mass spectrometer according to the third aspect of the present invention, the analysis operator previously sets, as the measurement conditions for optimizing the MRM measurement condition, the mass-to-charge ratio of a precursor ion to be selected as the target, the measurement starting time and the measurement finishing time for each objective compound through the measurement condition setter before carrying out the task of the MRM measurement condition optimization. The starting and finishing times of the measurement can be appropriately set based on the known retention time of each compound. After those measurement conditions are set, the measurement sequence creator creates a measurement sequence for one or more chromatograph mass-spectrometric analyses for performing the MRM measurement condition optimization of all the objective compounds, based on the information of the measurement starting times and the measurement finishing times which have been set.

That is to say, objective compounds which can be subjected to the measurement without causing any overlapping of the measurement times are sequentially selected with a lapse of time as the targets of a series of measurements performed in one chromatograph mass-spectrometric analysis. The compounds for which the MRM measurement condition optimization cannot be performed in the first chromatograph mass-spectrometric analysis due to the overlapping of the measurement times are pushed back to the second chromatograph mass-spectrometric analysis. If some compounds still remain to be the target of the MRM measurement condition optimization after the second chromatograph mass-spectrometric analysis, the third and subsequent chromatograph mass-spectrometric analyses may additionally be performed. After the measurement sequence is thus prepared, the MRM measurement condition optimizer conducts the MRM measurement condition optimization while controlling each section of the mass spectrometer according to that measurement sequence. In this manner, the MRM measurement condition optimization for all the objective compounds can be achieved with the smallest possible number of chromatograph mass-spectrometric analyses.

Naturally, it is possible to combine the control and process of the tandem quadrupole mass spectrometer according to the first or second aspect of the present invention with the tandem quadrupole mass spectrometer according to the third aspect of the present invention.

Advantageous Effects of the Invention

In the tandem quadrupole mass spectrometer according to the first or second aspect of the present invention, even if a product ion which must be selected as a target for an objective compound in an MRM measurement condition optimization has a low signal intensity as compared to other product ions, the search for an optimum value of a control parameter for that product ion will be assuredly performed. It is also possible to prevent the MRM measurement condition optimization from being performed for unnecessary or unwanted product ions, which prevents the working time from being unnecessarily wasted for those ions and thereby improves the efficiency of the MRM measurement condition optimization.

With the tandem quadrupole mass spectrometer according to the third aspect of the present invention, the MRM measurement condition optimization for a number of combinations of the mass-to-charge ratios of the precursor ion and the product ion originating from various objective compounds can be efficiently performed in a short period of time.

DESCRIPTION OF EMBODIMENTS

Figure 1:
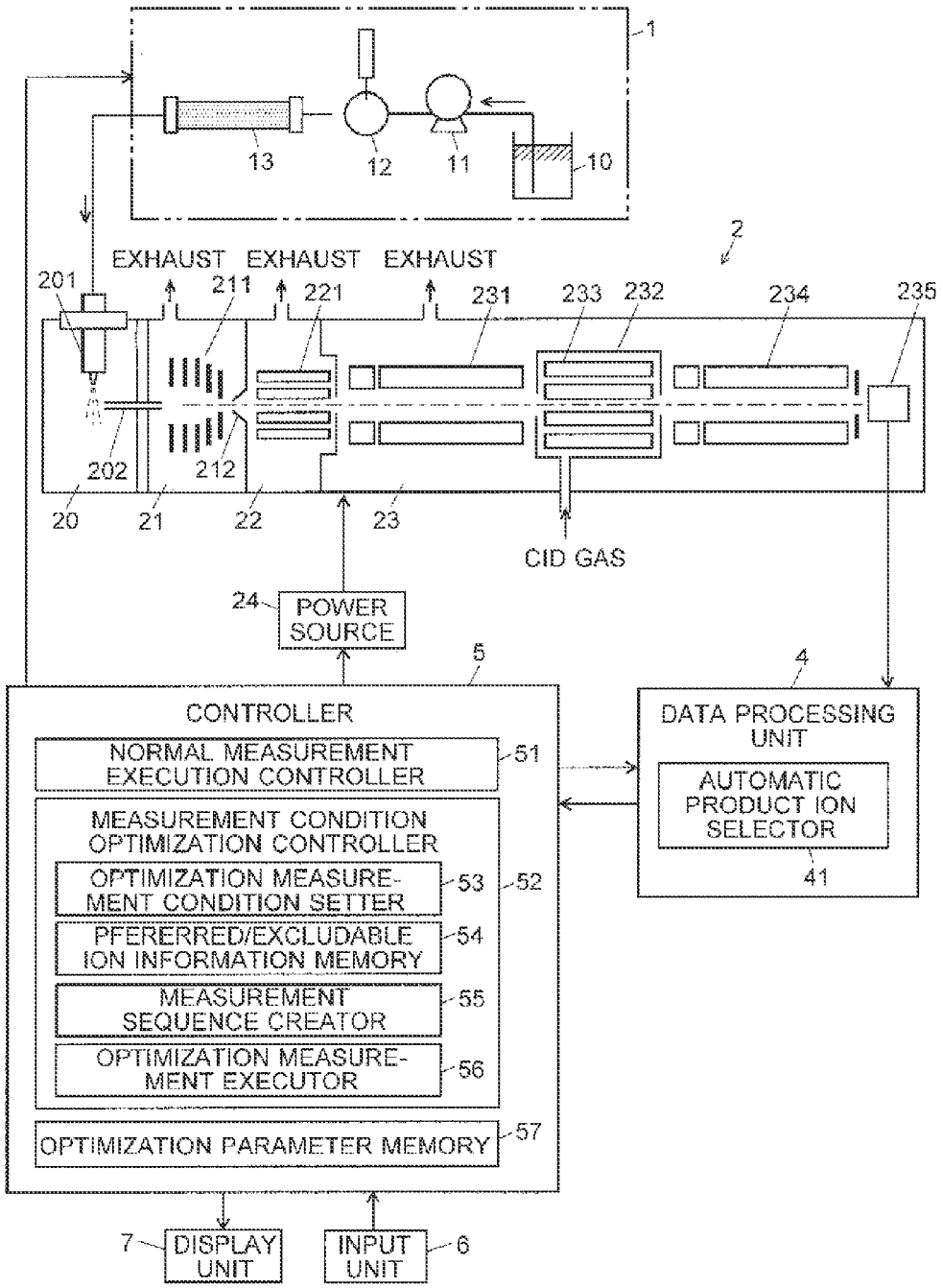
FIG. 1 is a configuration diagram showing the main components of a liquid chromatograph mass spectrometer using a tandem quadrupole mass spectrometer according to one embodiment of the present invention.

One embodiment of the liquid chromatograph mass spectrometer using a tandem quadrupole mass spectrometer according to the present invention is hereinafter described with reference to the attached drawings. FIG. 1 is a configuration diagram showing the main components of the liquid chromatograph mass spectrometer of the present embodiment.

In the liquid chromatograph mass spectrometer of the present embodiment, the liquid chromatograph unit 1 includes a mobile phase container 10 holding a mobile phase, a pump 11 for drawing and supplying the mobile phase at a constant flow rate, an injector 12 for injecting a predetermined amount of prepared sample into the mobile phase, and a column 13 for temporally separating various compounds contained in the sample. The pump 11 draws the mobile phase from the mobile phase container 10 and supplies it into the column 13 at a constant flow rate. When a predetermined amount of sample liquid is introduced from the injector 12 into the mobile phase, the sample is carried by the mobile phase and introduced into the column 13. While passing through the column 13, the various compounds in the sample are temporally separated, to be eventually eluted from the outlet of the column 13 and introduced into a mass spectrometer 2.

The mass spectrometer 2 has the configuration of a multistage differential pumping system including an ionization chamber 20 maintained at approximately atmospheric pressure and a high-vacuum analysis chamber 23 evacuated with a high-performance vacuum pump (not shown), between which first and second intermediate vacuum chambers 21 and 22 are provided having the degree of vacuum increased in a stepwise manner. The ionization chamber 20 has an electrospray ionization probe 201 for spraying sample solution while electrically charging this solution. The ionization chamber 20 communicates with the first intermediate vacuum chamber 21 in the next stage through a thin heated capillary 202. The first and second intermediate vacuum chambers 21 and 22 are separated by a skimmer 212 having a small hole at its apex. Ion guides 211 and 221 for transporting ions to the subsequent stage while focusing them are provided in the first and second intermediate vacuum chambers 21 and 22, respectively. The analysis chamber 23 contains a collision cell 232 including a multi-pole ion guide 233, the cell being sandwiched between a front-stage quadrupole mass filter 231 for separating ions according to their mass-to-charge ratios and a rear-stage quadrupole mass filter 234 for similarly separating ions according to their mass-to-charge ratios. An ion detector 235 is also provided in the analysis chamber 23.

When an MS/MS analysis is performed, a CID gas (e.g. argon or nitrogen) is continuously or intermittently supplied into the collision cell 232. A power source 24 applies predetermined voltages to the electrospray ionization probe 201, the ion guides 211, 221 and 233, the quadrupole mass filters 231 and 234 as well as other components, respectively. Each of the quadrupole mass filters 231 and 234 has pre-rod electrodes placed at the front end of the main rod electrodes so as to correct the electric field at the entrance end of the mass filter. The pre-rod electrodes can be supplied with voltages different from those applied to the main rod electrodes.

In the mass spectrometer 2, when the eluate from the column 13 reaches the electrospray ionization probe 201, the eluate is sprayed while being supplied with electric charges from the tip of the probe 201. The electrically charged droplets thus formed by the spraying process are progressively broken into smaller sizes by an electrostatic force due to the supplied electric charges. During this process, the solvent is vaporized and ions originating from the compounds are ejected. The generated ions are sent through the heated capillary 202 into the first intermediate vacuum chamber 21, where the ions are focused by the ion guide 211 and sent through the small hole at the apex of the skimmer 212 into the second intermediate vacuum chamber 22. In this chamber, the ions originating from the compounds are focused by the ion guide 221 and sent into the analysis chamber 23, where they are introduced into the space extending along the longitudinal axis of the front-stage quadrupole mass filter 231. It should be naturally understood that the ionization method is not limited to the electrospray ionization but other methods may be used, such as atmospheric pressure chemical ionization or atmospheric pressure photoionization.

When an MS/MS analysis is performed in the mass spectrometer 2, a predetermined voltage (composed of a radio-frequency voltage and a direct-current voltage superposed on each other) is applied from the power source 24 to each of the rod electrodes of the front-stage quadrupole mass filter 231 and the rear-stage quadrupole mass filter 234, while a CID gas is continuously or intermittently supplied into the collision cell 232. Among the various kinds of ions sent into the front-stage quadrupole mass filter 231, the ion having a specific mass-to-charge ratio corresponding to the voltages applied to the rod electrodes of the front-stage quadrupole mass filter 231 is allowed to pass through this filter 231 and be introduced into the collision cell 232 as a precursor ion. Within the collision cell 232, the precursor ion collides with the CID gas and becomes dissociated, generating various kinds of product ions. The generated product ions are introduced into the rear-stage quadrupole mass filter 234, where only a product ion having a specific mass-to-charge ratio corresponding to the voltages applied to the rod electrodes of the rear-stage quadrupole mass filter 234 is allowed to pass through this filter 234, to eventually arrive at and be detected by the ion detector 235. The ion detector 235, an example of which is a pulse-counting detector, generates pulse signals whose number corresponds to the number of incident ions. Those signals are sent to a data processing unit 4 as detection signals.

The data processing unit 4 includes an automatic product ion selector 41 as a functional block. A control unit 5 having an input unit 6 and a display unit 7 connected is a unit for controlling the operations of the pump 11 and the injector 12 in the liquid chromatograph unit 1 as well as those of the power source 24, the CID gas supplier (not shown) and other components in the mass spectrometer 2. The control unit 5 includes a normal measurement execution controller 51, a measurement condition optimization controller 52, an optimum parameter memory 57 and other functional blocks. The measurement condition optimization controller 52 includes an optimization measurement condition setter 53, a preferred/excludable ion information memory 54, a measurement sequence creator 55, an optimization measurement executer 56 and other components. The normal measurement execution controller 51 controls each section of the mass spectrometer when a chromatograph mass-spectrometric analysis of an objective sample is performed for the purpose of identification (qualitative analysis), quantitative determination or other analyses of a compound in the objective sample. The measurement condition optimization controller 52 controls each section of the mass spectrometer in a preliminary measurement performed for an optimization of control parameters for controlling each section of the system in various kinds of measurements, such as an MRM measurement condition optimization which will be described later. The optimum parameter memory 57 is used for storing the values of the control parameters obtained under the control of the measurement condition optimization controller 52 so that those value can be used later for a measurement to be performed under the control of the normal measurement execution controller 51.

At least a portion of the functions of the control unit 5 and the data processing unit 4 can be realized by installing a dedicated controlling and processing software program on a personal computer provided as hardware resources and executing this program on that computer.

Figure 2:
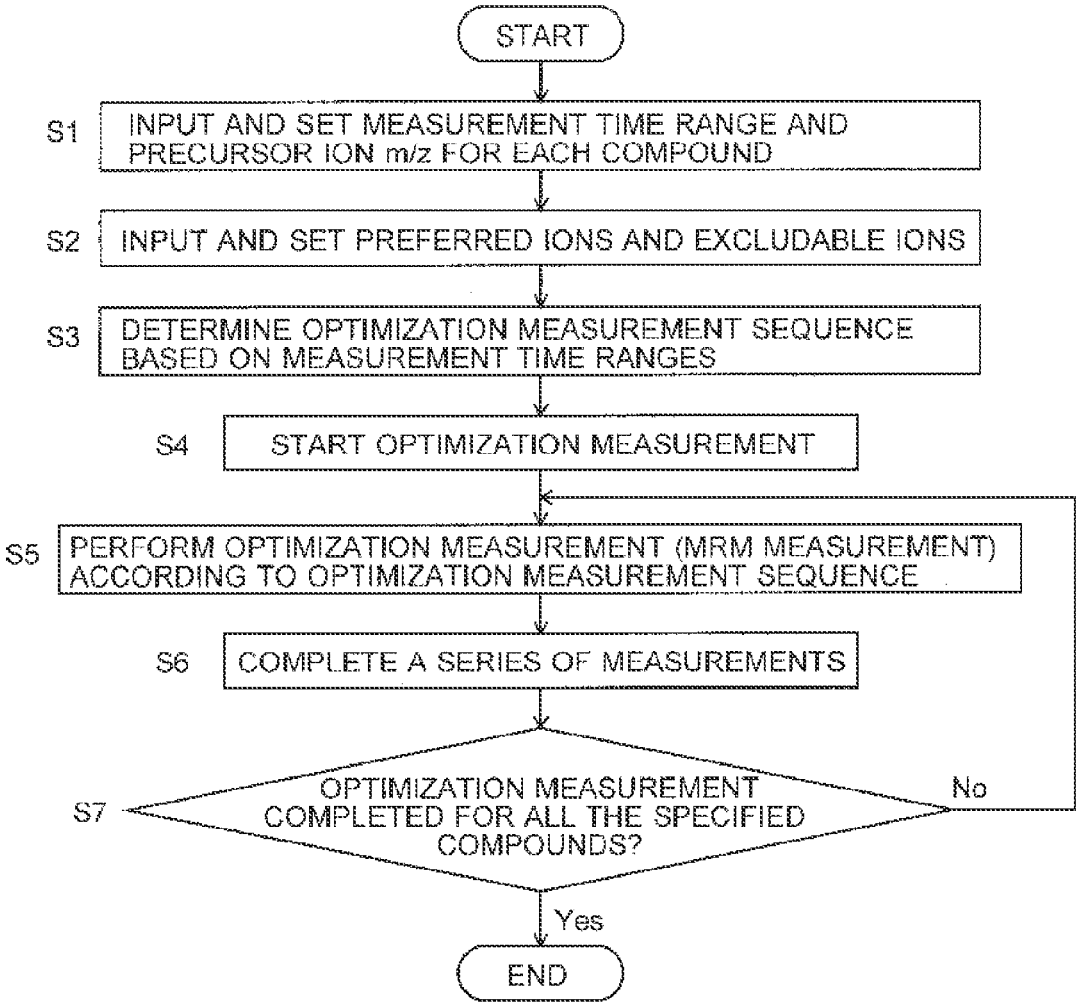
FIG. 2 is a flowchart of the process of performing an MRM measurement condition optimization in the liquid chromatograph mass spectrometer of the present embodiment.
Figure 3:
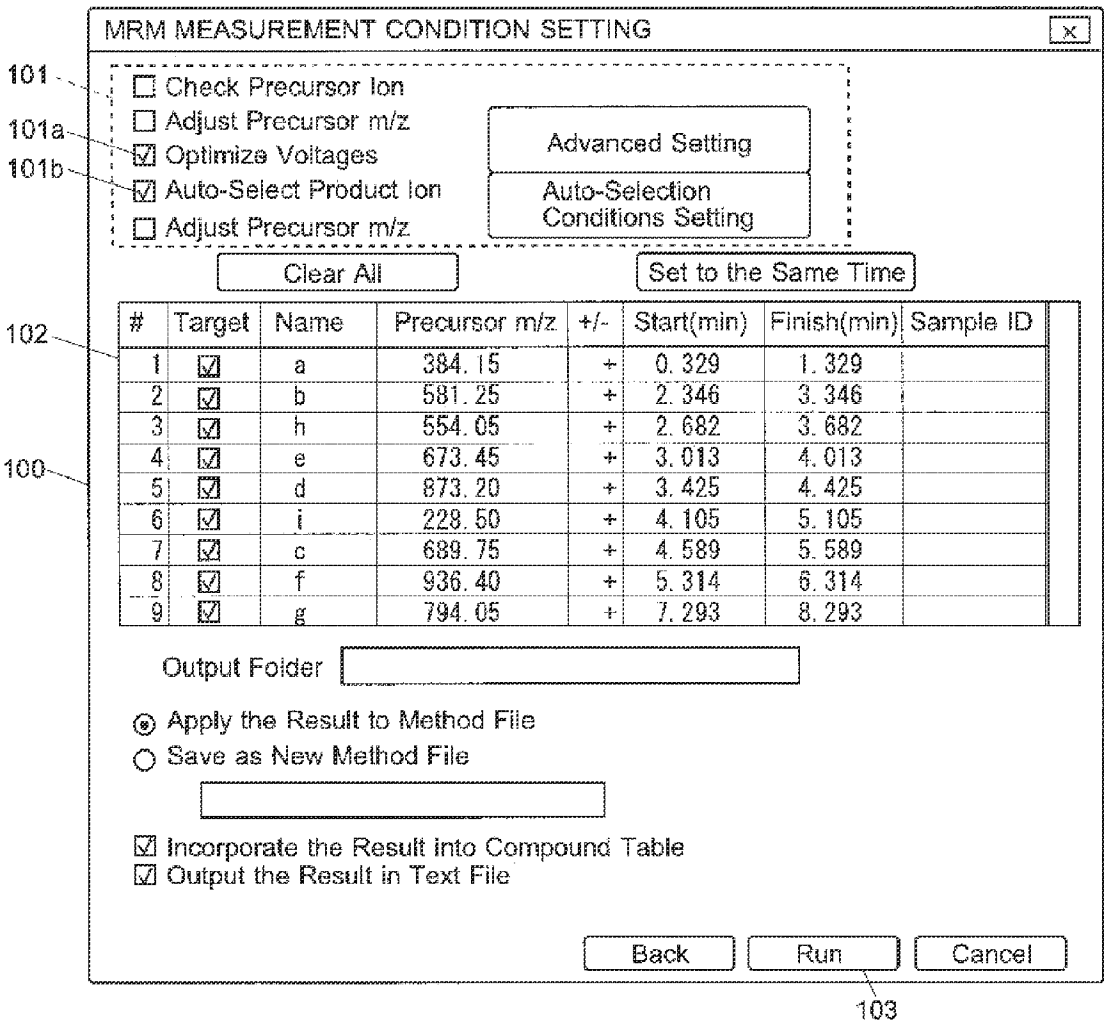
FIG. 3 is one example of the MRM measurement condition setting screen used in the process of performing an MRM measurement condition optimization in the liquid chromatograph mass spectrometer of the present embodiment.
Figure 4:
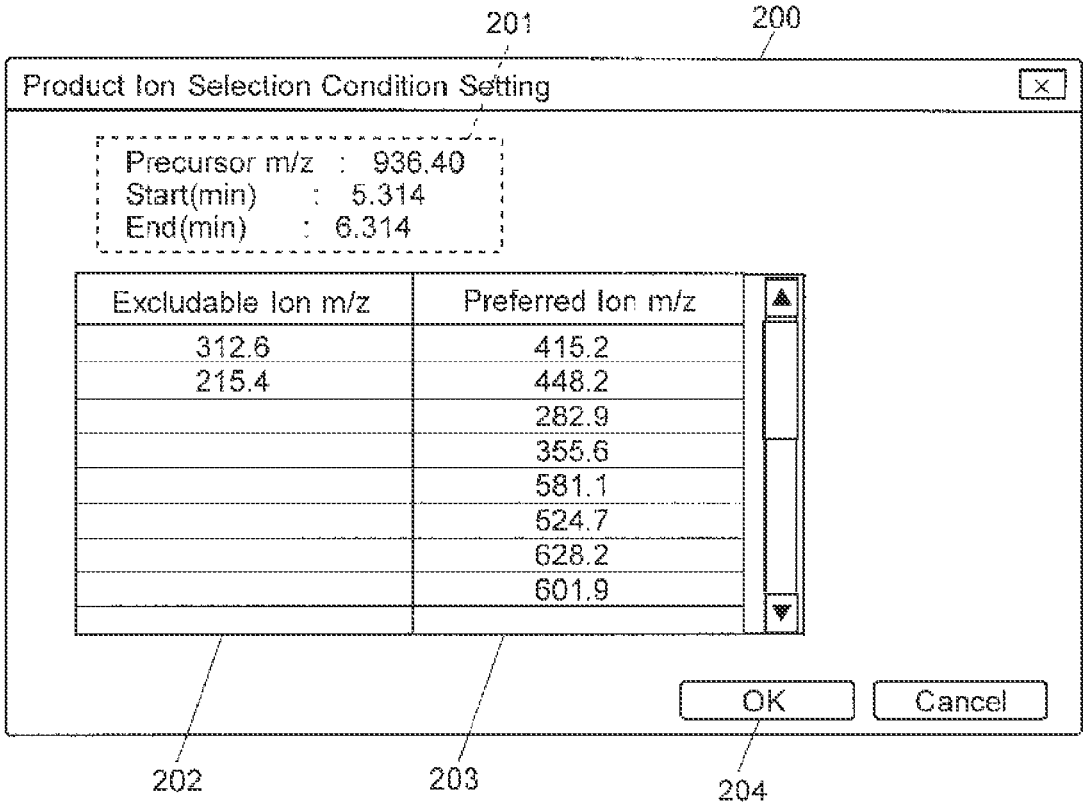
FIG. 4 is one example of the product-ion selection condition setting screen used in the process of performing an MRM measurement condition optimization in the liquid chromatograph mass spectrometer of the present embodiment.

The liquid chromatograph mass spectrometer of the present embodiment is characterized by the control and the process of MRM measurement condition optimization (i.e. optimization of the measurement conditions for an MRM measurement). This point is hereinafter described with reference to FIGS. 2-4. FIG. 2 is a flowchart of the process of performing an MRM measurement condition optimization in the liquid chromatograph mass spectrometer of the present embodiment. FIGS. 3 and 4 show one example of an MRM measurement condition setting screen and a product-ion selection condition setting screen used in the process of performing the MRM measurement condition optimization in the liquid chromatograph mass spectrometer of the present embodiment.

In advance of the MRM measurement condition optimization, an analysis operator inputs and sets the range of the measurement time and the mass-to-charge ratio of the precursor ion to be selected as the target for each objective compound which should be a target of the optimization, using the input unit 6 (Step S1). An objective compound in this stage is a compound which is contained in an objective sample and whose quantity needs to be determined.

More specifically, when the analysis operator performs a predetermined operation on the input unit 6, the optimization measurement condition setter 53 in the control unit 5 displays, on the screen of the display unit 7, an MRM measurement condition setting screen 100 as shown in FIG. 3. In the case where the voltages applied to each section and the collision energy need be optimized as the MRM measurement conditions, a check should be marked to the "Optimize Voltages" checkbox 101*a* inside the item setting area 101 in the MRM measurement condition setting screen 100 to select this item. To use the function of automatically searching for a target product ion for each compound instead of directly entering the mass-to-charge ratio of the product ion, a check should be marked to the "Auto-Select Product Ion" checkbox 101*b* to select this item. Furthermore, the compound name, the mass-to-charge ratio of a target precursor ion for this compound ("Precursor m/z"), the polarity of the precursor ion ("+/−"), the measurement starting time ("Start (min)"), the measurement finishing time ("Finish (min)"), and other items of information should be entered for each objective compound in the measurement target compound table 102. The measurement starting time and the measurement finishing time can be determined based on the known retention time of each objective compound, with an appropriate amount of temporal allowance around the retention time (which is ±0.5 minutes in the present example).

In the present example, when "Optimize Voltages" is selected, the voltages applied to the pre-rod electrodes of the front-stage quadrupole mass filter 231, the voltages applied to pre-rod electrodes of the rear-stage quadrupole mass filter 234, the collision energy and the like can be selectively optimized. More detailed conditions, such as the selection of the parts to be selected as the target of the optimization or the voltage ranges, can be set on a screen which is newly opened when the "Advanced Setting" button is clicked.

When the "Auto-Select Product Ion" is selected, the analysis operator is allowed to specify preferred ions and excludable ions regarding the selection of the target product ions for each precursor ion. Specifically, this is achieved as follows: When the analysis operator, using the input unit 6, clicks an arbitrary row (i.e. a row which shows the mass-to-charge ratio and other items of information about a desired kind of precursor ion) among the rows of the measurement target compound table 102 on the MRM measurement condition setting screen 100, the optimization measurement condition setter 53 displays a product-ion selection condition setting screen 200 for the specified product ion on the screen of the display unit 7, as shown in FIG. 4. The product-ion selection condition setting screen 200 has an area 201 for showing information about the precursor ion in question, a list 202 for showing excludable ions and a list 203 for showing preferred ions.

The analysis operator enters the mass-to-charge ratios of the product ions which should be excluded from the MRM measurement condition optimization, as well as those of the product ions for which the MRM measurement condition optimization should be preferentially performed, into the excludable-ion list 202 and the preferred-ion list 203, respectively. For example, when known kinds of impurities are possibly mixed in the mobile phase of the liquid chromatograph, it is possible to register, as excludable ions, product ions originating from those impurities and/or product ions originating from other components whose retention times are close to those of the objective component. If the product ions to be generated from a precursor ion originating from the objective compound are known to a certain extent, those product ions can be registered as preferred ions. When the entry of the excludable and preferred ions are completed, the "OK" button 204 should be clicked to fix the entry. The fixed information about the excludable and preferred ions is stored into the excludable/preferred ion information memory 54. By repeating such a task for each precursor-ion listed in the measurement target compound table 102, the analysis operator can specify a different set of preferred and excludable ions for each and every precursor ion.

Subsequently, when the analysis operator clicks the "Run" button 103 on the MRM measurement condition setting screen 100, the measurement sequence creator 55 creates a measurement sequence for performing the MRM measurement optimization based on the information described in the measurement target compound table 102 at that point in time (Step S3). Specifically, this task is performed by the measurement sequence creator 55 as follows: Initially, information about the measurement starting times and the measurement finishing times of all the compounds registered in the measurement target compound table 102 is collected and the measurement time range of each compound is determined. Then, the compounds are selected in order of time under the condition that none of the selected compounds have their measurement time ranges overlapping each other. For example, in the example of FIG. 3, the measurement time range of compound b (2.346-3.346 min) is overlapped with those of compound h (2.682-3.682 min) and compound e (3.013-4.013 min). Therefore, after compounds a and b are sequentially selected, it is compound d (having a measurement time range of 3.425-4.425 min) that can be subsequently selected in order of time. This means that compounds h and e are bypassed at this stage. In this manner, the selection of the compounds is continued, with each compound being examined for the overlapping of the measurement time range, until the compound having the last measurement time range is reached. Then, a measurement sequence is determined so that the compounds selected in the first stage will be sequentially subjected to the measurement. In the next stage, the compounds which have not been selected in the first stage are similarly selected in order of time under the condition that none of the selected compounds have their measurement time ranges overlapping each other. The selection of the compounds is continued, with each compound being examined for the overlapping of the measurement time range, until the compound having the last measurement time range is reached. Then, a measurement sequence is determined so that the compounds selected in the second stage will be sequentially subjected to the measurement. The processes described thus far are repeated until all the compounds are selected without omission. As a result, a measurement sequence for n times of measurements is obtained. In some cases, the value of n is one. If there are a number of compounds whose retention times are close to each other, the value of n will be greater.

After the measurement sequence for all the objective compounds are determined in the previously described way, the optimization measurement executer 56 performs the MRM measurement condition optimization while conducting a chromatograph mass spectrometry for a prepared sample according to that measurement sequence (Steps S4 and S5). The sample used in this measurement is a known sample containing the compounds specified by the analysis operator in Step S1 (i.e. compounds a, b, h, and so on in the example of FIG. 3).

With the initiation of the measurement, the sample is injected from the injector 12 into the mobile phase supplied through the pump 11 in the liquid chromatograph unit 1. While the sample is passing through the column 13, the components in the sample are temporally separated into compounds and sequentially introduced into the mass spectrometer 2. In the mass spectrometer 2, for each measurement time range specified in the measurement sequence, MRM measurement condition optimization for a precursor ion originating from the compound linked with that measurement time range is performed, in which process the automatic product ion selector 41 in the data processing unit 4 determines a product ion for which the MRM measurement condition optimization needs to be performed.

Specifically, the product ion is determined as follows. Initially, a product-ion scan measurement is performed over a predetermined range of mass-to-charge ratios for a precursor ion originating from an objective compound. Based on the detection signals obtained with the ion detector 235 in this measurement, the automatic product ion selector 41 creates a product-ion spectrum and performs the following processes: Each peak satisfying a certain condition (e.g. each peak whose intensity is equal to or higher than a predetermined threshold) is extracted from the peaks present on this product-ion spectrum, and the mass-to-charge ratio corresponding to each extracted peak is determined. The mass-to-charge ratios thus obtained are the mass-to-charge ratios of the product-ion candidates. Subsequently, information of the preferred and excludable ions registered for the precursor ion originating from the objective compound concerned is retrieved from the preferred/excludable ion information memory 54. If excludable ions are specified in the information, the aforementioned product-ion candidates are searched for each of those excludable ions and any ion which has been found by this search is excluded from the product-ion candidates. On the other hand, if preferred ions are specified in the information, the aforementioned product-ion candidates are searched for each of those preferred ions and any ion which has been found by this search is adopted as a product ion. If no preferred ion is specified, the product ions can be determined, for example, by selecting a specified number of ions from the product-ion candidates in descending order of peak intensity. If there is only a small number of preferred ions specified, those preferred ions should be selected first, after which an appropriate number of ions can be additionally selected as product ions from the remaining candidates of the product ions in descending order of peak intensity.

Thus, for each objective compound, the automatic product ion selector 41 determines one or a predetermined number of product ions for which the MRM measurement condition optimization needs to be performed. The information about the product ions thus determined is sent to the optimization measurement executer 56, which performs the MRM measurement condition optimization for each combination of the mass-to-charge ratios of the precursor ion originating from the objective compound and a product ion. For example, the ion signal intensity related to the determined combination of the mass-to-charge ratios of the precursor ion and the product ion is measured while the collision energy is sequentially set at a plurality of preset levels, so as to find the collision energy at which the signal intensity is maximized. Similar searches are also conducted to find optimum values of the voltages applied to the pre-rod electrodes of each quadrupole mass filter 231 or 234. If there are two or more product ions determined for a precursor ion originating from one compound, the search for the optimum values of the collision energy and the applied voltages is performed for each combination of the mass-to-charge ratios of that precursor ion and those product ions. Such a series of processes are carried out within each measurement time range specified in the measurement sequence. Therefore, within each measurement time range, optimum values of the control parameters are obtained for each of a plurality of combinations of the mass-to-charge ratios of the precursor ion and the product ions for one kind of compound. The obtained optimum values of the control parameters are stored in the optimum parameter memory 57.

After a series of measurements for one injection of the sample are completed (Step S6), it is determined whether or not the MRM measurement condition optimization for all the specified compounds has been completed (Step S7). If there is any compound for which the MRM measurement condition optimization has not been performed, i.e. if there is any measurement sequence remaining to be carried out, the operation returns to Step S5. Then, according to the measurement sequence, the same sample is injected and the liquid chromatograph mass spectrometry is performed for the second time to carry out the MRM measurement condition optimization for the remaining compounds. Ultimately, when the MRM measurement condition optimization for all the objective compounds is completed, the measurements and processes are discontinued.

As a result of the measurements and processes described thus far, optimum values of the control parameters to be used in an MRM measurement are determined for each combination of the mass-to-charge ratios of the precursor ion and the product ion originating from an objective compound, and the obtained values are stored in the optimum parameter memory 57. Later on, when the MRM measurement is performed so as to determine the quantity of the objective compound contained in an unknown sample, the normal measurement execution controller 51 controls each section of the mass spectrometer 2, using the optimum values of the control parameters saved in the optimum parameter memory 57. Therefore, the result of this MRM measurement is obtained under optimum conditions for the quantitative determination, and high levels of accuracy and sensitivity in the quantitative determination can be achieved.

It should be noted that the previous embodiment is a mere example of the present invention, and any change, addition or modification appropriately made within the spirit of the present invention will be evidently included within the scope of claims of the present patent application.

REFERENCE SIGNS LIST

1 . . . Liquid Chromatograph Unit
10 . . . Mobile Phase Container
11 . . . Pump
12 . . . Injector
13 . . . Column
2 . . . Mass Spectrometer
20 . . . Ionization Chamber
201 . . . Electrospray Ionization Probe
202 . . . Heated Capillary
21, 22 . . . Intermediate Vacuum Chamber
211, 221 . . . Ion Guide
212 . . . Skimmer
23 . . . Analysis Chamber
231 . . . Front-Stage Quadrupole Mass Filter
232 . . . Collision Cell
233 . . . Multi-Pole Ion Guide
234 . . . Rear-Stage Quadrupole Mass Filter
235 . . . Ion Detector
24 . . . Power Source
4 . . . Data Processing Unit
41 . . . Automatic Product Ion Selector

5 . . . Control Unit
51 . . . Normal Measurement Execution Controller
52 . . . Measurement Condition Optimization Controller
53 . . . Optimization Measurement Condition Setter
54 . . . Preferred/Excludable Ion Information Memory
55 . . . Measurement Sequence Creator
56 . . . Optimization Measurement Executor
57 . . . Optimum Parameter Memory
6 . . . Input Unit
7 . . . Display Unit

The invention claimed is:

1. A tandem quadrupole mass spectrometer having front-stage and rear-stage quadrupole mass filters with a collision cell for fragmenting an ion in between, the tandem quadrupole mass spectrometer having a function of performing a multiple reaction monitoring (MRM) measurement condition optimization for searching for an optimum MRM measurement condition for one or a plurality of compounds while conducting an MRM measurement of a sample, and the tandem quadrupole mass spectrometer comprising:

a) a preferred ion registry for registering a mass-to-charge ratio of one or a plurality of product ions to be preferentially selected as a target, for each precursor ion, as a measurement condition for optimizing the MRM measurement condition; and b) an MRM measurement condition optimizer for performing the MRM measurement condition optimization for a target precursor ion originating from one compound by retrieving information about a preferred product ion for the precursor ion from the preferred ion registry, and if the preferred product ion is detected as a product ion for the precursor ion, controlling each section of the mass spectrometer so as to perform the MRM measurement condition optimization for a combination of the mass-to-charge ratios of the precursor ion and the preferred product ion and obtain an optimum value of a control parameter.

2. A tandem quadrupole mass spectrometer having front-stage and rear-stage quadrupole mass filters with a collision cell for fragmenting an ion in between, the tandem quadrupole mass spectrometer having a function of performing a multiple reaction monitoring (MRM) measurement condition optimization for searching for an optimum MRM measurement condition for one or a plurality of compounds while conducting an MRM measurement of a sample, and the tandem quadrupole mass spectrometer comprising:

a) an excludable ion registry for registering a mass-to-charge ratio of one or a plurality of product ions to be excluded from a target of the MRM measurement condition optimization, for each precursor ion, as a measurement condition for optimizing the MRM measurement condition; and b) an MRM measurement condition optimizer for performing the MRM measurement condition optimization for a target precursor ion originating from one compound by retrieving information about an excludable product ion or ions for the precursor ion from the excludable ion registry, excluding at least the excludable product ion or ions from the ions detected as product ions for the precursor ion, and controlling each section of the mass spectrometer so as to perform the MRM measurement condition optimization for a combination of the mass-to-charge ratios of the precursor ion and a product ion remaining after exclusion and obtain an optimum value of a control parameter.

3. A tandem quadrupole mass spectrometer having a function of performing a multiple reaction monitoring (MRM) measurement condition optimization for searching for an optimum MRM measurement condition for one or a plurality of compounds while conducting an MRM measurement of a sample, with a chromatograph for temporally separating compounds in a sample connected on a front side, the tandem quadrupole mass spectrometer including: an ion source for ionizing components of an introduced sample; a front-stage quadrupole mass filter for selecting, as a precursor ion, an ion having a specific mass-to-charge ratio among various kinds of ions generated in the ion source; a collision cell for dissociating the precursor ion; a rear-stage quadrupole mass filter for selecting an ion having a specific mass-to-charge-ratio from various kinds of product ions resulting from the dissociation; and a detector for detecting an ion passing through the rear-stage quadrupole mass filter, and the tandem quadrupole mass spectrometer further comprising:

a) a measurement condition setter for setting, for each objective compound, a mass-to-charge ratio of a precursor ion to be selected as a target, a measurement starting time and a measurement finishing time as measurement conditions for optimizing the MRM measurement condition;

b) a measurement sequence creator for creating a measurement sequence for an MRM measurement condition optimization, based on information of the measurement starting time and the measurement finishing time set in the measurement condition setter, so that the MRM measurement condition optimization for all objective compounds is performed with a smallest possible number of chromatographic analyses by selecting, sequentially with a lapse of time, objective compounds capable of being subjected to a measurement without causing any overlapping of measurement times, which results in a series of measurements in each chromatographic analysis, and by performing the MRM measurement condition optimization for each objective compound; and c) an MRM measurement condition optimizer for conducting the MRM measurement condition optimization while controlling each section of the mass spectrometer according to the measurement sequence created by the measurement sequence creator.

* * * * *